US009222484B2

(12) United States Patent
Stirling

(10) Patent No.: US 9,222,484 B2
(45) Date of Patent: Dec. 29, 2015

(54) CENTRIFUGAL PUMP CASING WITH OFFSET DISCHARGE

(71) Applicant: Weir Minerals Australia, Ltd., Artarmon NSW (AU)

(72) Inventor: Thomas E. Stirling, Drums, PA (US)

(73) Assignee: Weir Minerals Australia, Ltd. (AU)

( * ) Notice: Subject to any disclaimer, the term of this patent is extended or adjusted under 35 U.S.C. 154(b) by 0 days.

(21) Appl. No.: 13/871,681

(22) Filed: Apr. 26, 2013

(65) Prior Publication Data

US 2013/0287559 A1 Oct. 31, 2013

Related U.S. Application Data

(60) Provisional application No. 61/639,774, filed on Apr. 27, 2012.

(51) Int. Cl.
*F04D 29/42* (2006.01)
*F04D 29/40* (2006.01)

(52) U.S. Cl.
CPC ..... *F04D 29/40* (2013.01); *F04D 29/428* (2013.01)

(58) Field of Classification Search
CPC ... F04D 29/422; F04D 29/426; F04D 29/428; F04D 29/442; F04D 29/4206
USPC ..... 415/206
See application file for complete search history.

(56) References Cited

U.S. PATENT DOCUMENTS

| | | | | |
|---|---|---|---|---|
| 1,215,881 | A | 2/1917 | Siemen | |
| 3,950,112 | A | 4/1976 | Crump et al. | |
| 4,213,742 | A | 7/1980 | Henshaw | |
| 4,389,159 | A * | 6/1983 | Sarvanne | 415/224.5 |
| 4,406,583 | A | 9/1983 | Becker et al. | |
| 4,778,336 | A | 10/1988 | Husain | |
| 6,126,392 | A * | 10/2000 | Sabini | 415/118 |
| 6,146,095 | A | 11/2000 | Bross et al. | |
| 6,988,870 | B2 * | 1/2006 | Walker | 415/128 |
| 7,517,186 | B2 | 4/2009 | Seitz et al. | |
| 2011/0142610 | A1 | 6/2011 | Burgess et al. | |
| 2011/0311357 | A1 | 12/2011 | Rodrigues | |

FOREIGN PATENT DOCUMENTS

EP 1903216 A1 3/2008

OTHER PUBLICATIONS

Warman, Centrifugal Slurry Pumps, Catalog (online), Weir Minerals, 2008, http://www.weirminerals.com/pdf/AH-NA1108%20Warman%20AH%20pump%20brochure.pdf.

* cited by examiner

*Primary Examiner* — Craig Kim
*Assistant Examiner* — Jason Davis
(74) *Attorney, Agent, or Firm* — Morriss O'Bryant Compagni

(57) ABSTRACT

A pump casing having a casing body is configured with a discharge formed in the casing body where a midline of the discharge is offset from a tangent line of the casing body and offset from a centerline of the casing body, such that the midline of the discharge is located along a point between the defined centerline and defined tangent line of the casing body.

3 Claims, 5 Drawing Sheets

CENTRIFUGAL PUMP CASING WITH OFFSET DISCHARGE

TECHNICAL FIELD

This disclosure relates in general to centrifugal pumps used in various industrial applications and, in particular, relates to an improved pump casing configuration for centrifugal pumps where the discharge is advantageously positioned relative to the circumferential profile of the pump casing.

BACKGROUND OF THE DISCLOSURE

Centrifugal pumps are used in a variety of industries to process and transport fluids. The type and configuration of centrifugal pumps vary widely, but are typically comprised of a pump casing having an inlet for receiving a fluid into the pump, a discharge outlet for transporting fluid away from the pump casing, and at least one impeller for drawing fluid into the pump and moving the fluid to a pumping chamber that is in fluid communication with the discharge outlet.

The configuration and arrangement of the basic elements of centrifugal pumps are determined or influenced in part by the type of fluids that are being processed. For example, processing slurries, or liquids that contain solids, requires a different type of pump configuration as compared to pumps used for processing clear liquids, or those which contain little or no solids. In general, centrifugal slurry pumps may generally be larger in size than centrifugal pumps used for processing clear liquids. Also, the area where the centrifugal pump is installed may influence the dimensions and configuration of the pump. For example, the size of an industrial plant, the size of a truck bed or skid and constraints on piping configurations may influence the size, type or configuration of pump that may be employed in the particular space of the plant.

In operation at an industrial site, it may become necessary or desirable to process a different type of fluid than had previously been processed at the site, and a repurposing of an existing industrial site may require the use of different centrifugal pumps than had previously been used at that site. Therefore, the need or desire may arise for replacing the existing or previously-used pumps with a new type of pump, such as replacing the clear fluid process pumps with slurry pumps.

The replacement of one type of pump for a different type of pump is difficult, however, because the piping to which the pumps are connected to provide a flow pathway for the processed fluids is not easily reconfigured. Attempting to reconfigure the piping network to accommodate a new type or configuration of a pump may be very costly and time consuming. More importantly, pump efficiencies may be sacrificed in an effort to repurpose the plant by employing a new type of pump. Therefore, attention must be paid to providing a pump configuration that will enable substitution of the new pump for the old pump without losing pumping efficiencies.

SUMMARY

In a first aspect, embodiments are disclosed of a pump casing for a centrifugal pump comprising a casing body having a circumferential portion and a centerline, an opening formed in the casing body to provide receipt of a drive shaft therethrough, an opening formed in the casing body to provide an inlet pathway for fluid to enter the casing body, and a discharge formed in the casing body, the discharge having a midline, and wherein the midline of the discharge is located at a point between the centerline of the casing body and a tangential line extending parallel to the centerline of the casing body. This aspect of the disclosure has a particular advantage of providing a pump that can be adapted for use in an existing piping assembly without the need for costly reconfiguration of the piping assembly.

In certain embodiments, the midline of the discharge is parallel to the centerline and tangential line of the casing body.

In other certain embodiments, the midline of the discharge is located at a midpoint of the distance between the centerline of the casing body and the tangential line of the casing body.

In yet another embodiment, the discharge comprises a flange associated with the discharge.

In another aspect of the disclosure, a pump casing for a centrifugal pump comprises a casing body having a circumferential portion and a center defined relative to the circumferential portion, a discharge extending from the circumferential portion of the casing body, the discharge having a midline defining a fluid pathway for discharge of fluid from the casing body, and a cutwater having a leading edge, wherein, the casing body has a centerline extending through the center of the casing body and a tangent line defined by the circumferential portion of the pump casing, and further wherein the midline of the discharge is positioned between the centerline and tangent line of the pump casing. The pump casing of this aspect of the disclosure has the particular advantage of enabling the pump casing to be used in any number of pumping applications and in any orientation while maintaining operating efficiencies.

In certain embodiments, the distance between the midline of the discharge and the centerline of the pump casing is from about 20% to about 80% of the distance between the centerline of the pump casing and the tangent line of the pump casing.

In other embodiments, the distance between the centerline of the pump casing and midline of the discharge may be from about 30% to about 70% of the distance between the centerline of the pump casing and the tangent line of the pump casing.

In still other embodiments, the distance between the centerline of the pump casing and midline of the discharge may be from about 40% to about 70% of the distance between the centerline of the pump casing and the tangent line of the pump casing.

In yet other embodiments, the distance between the centerline of the pump casing and midline of the discharge may be from about 50% to about 70% of the distance between the centerline of the pump casing and the tangent line of the pump casing.

In other embodiments, the distance between the centerline of the pump casing and midline of the discharge may be from about 60% to about 70% of the distance between the centerline of the pump casing and the tangent line of the pump casing.

In other embodiments, the distance between the centerline of the pump casing and the midline of the discharge may be from about 62% to about 68% of the distance between the centerline of the pump casing and the tangent line of the pump casing.

And in other embodiments, the distance between the centerline of the pump casing and midline of the discharge may be greater than 60%, but less than or equal to 80% of the distance between the centerline of the pump casing and the tangent line of the pump casing.

In certain other embodiments, the leading edge of the cutwater is positioned at an angle to a horizontal axis line X positioned and extending through the center of the casing body when the midline of the discharge is in a vertical orientation, the angle being between five degrees and fifty degrees from the horizontal axis line X.

In some embodiments, the angle is from about five degrees to about fifty degrees from the horizontal axis line X.

In one particularly embodiment, the angle is from about five degrees to about forty degrees from the horizontal axis line X.

In another suitable embodiment, the angle is from about five degrees to about thirty degrees from the horizontal axis line X.

In yet another embodiment, the angle is from about five degrees to about twenty degrees from the horizontal axis line X.

In still other embodiments, the angle is from about five degrees to about fifteen degrees from the horizontal axis line X.

In other embodiments, the angle is from about seven degrees to about thirteen degrees from the horizontal axis line X.

In still other embodiments, the angle is from about nine degrees to about eleven degrees from the horizontal axis line X.

In yet other embodiments, the angle is greater than zero degrees, and is less than fifty degrees from the horizontal axis line X.

In another aspect of the disclosure, a centrifugal pump comprising a pump casing for a centrifugal pump comprises a casing body having a circumferential portion and a center defined relative to the circumferential portion, a discharge extending from the circumferential portion of the casing body, the discharge having a midline defining a fluid pathway for discharge of fluid from the casing body, and a cutwater having a leading edge, wherein, the casing body has a centerline extending through the center of the casing body and a tangent line defined by the circumferential portion of the pump casing, and further wherein the midline of the discharge is positioned between the centerline and tangent line of the pump casing, a drive shaft and an impeller operatively connected to the drive shaft. The centrifugal pump of this aspect provides an advantage of enabling the centrifugal pump to be used in any number of pumping applications and in any orientation while maintaining operating efficiencies.

In certain embodiments of the centrifugal pump, the distance between the midline of the discharge and the centerline is between fifty percent and eighty percent of the distance between the centerline and the tangent line of the pump casing.

In certain other embodiments of the centrifugal pump, the leading edge of the cutwater is positioned at an angle to a horizontal axis line X positioned and extending through the center of the casing body when the midline of the discharge is in a vertical orientation, the angle being between five degrees and fifty degrees from the horizontal axis line X.

In some embodiments of the centrifugal pump, the angle is between ten degrees and twenty-five degrees from the horizontal axis line X.

Other aspects, features, and advantages will become apparent from the following detailed description when taken in conjunction with the accompanying drawings, which are a part of this disclosure and which illustrate, by way of example, principles of the inventions disclosed.

DESCRIPTION OF THE FIGURES

The accompanying drawings facilitate an understanding of the various embodiments in which.

DETAILED DESCRIPTION

Figure 1A:
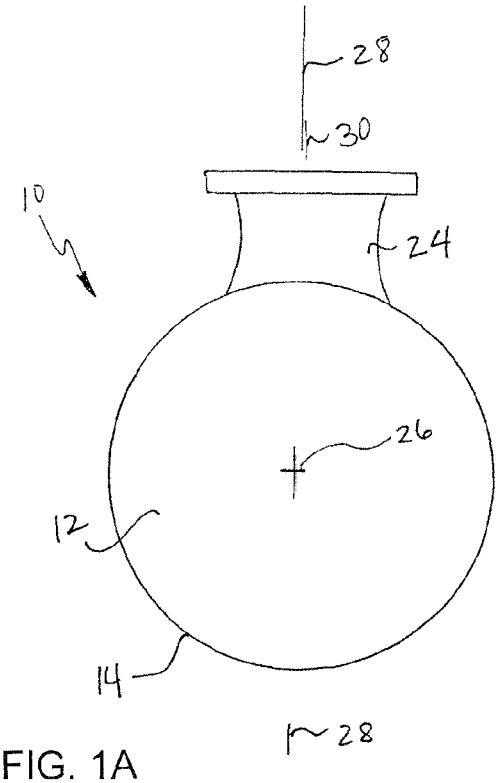
FIG. 1A (PRIOR ART)
FIG. 1A is a view in elevation of a schematic depiction of a prior art pump casing having a discharge outlet positioned at the centerline of the pump casing.
Figure 1B:
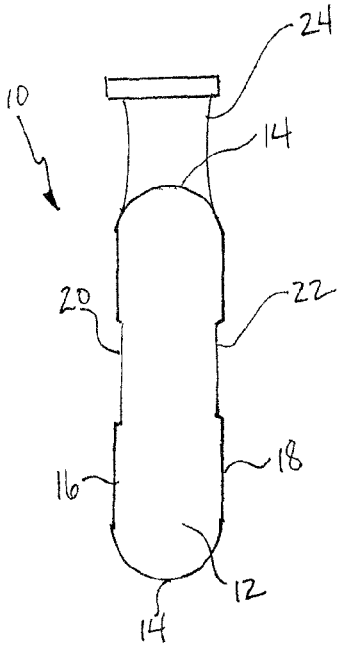
FIG. 1B (PRIOR ART)
FIG. 1B is a side view in elevation of the pump casing shown in FIG. 1A.

As background to the understanding of the embodiments described in the present disclosure, the principle elements of a pump casing are described in terms of conventional pump casing arrangements. For example, FIGS. 1A and 1B illustrate schematically a pump casing 10 that comprises a casing body 12 having a circumferential portion 14 defining the outer periphery of the casing body 12. The pump casing 10 comprises a first side 16 and a second side 18 spaced apart from the first side. The first side 16 and second side 18 of the casing body, in conjunction with the circumferential portion 14, define an interior space or chamber that is sized to accommodate an impeller (not shown) within the casing body 12.

As is conventionally known, the casing body is structured with a first opening 20 in one side of the casing body 12, here shown as the first side 16, through which a drive shaft (not shown) is positioned for securement to the impeller in known fashion. Thus, the first side 16 of the casing body 12 may be referred to as the drive side of the pump casing 10. The casing body 12 is additionally formed with a second opening 22, shown in FIG. 1B as being formed in the second side 18 of the casing body, through which fluid enters the pump casing 10. Thus, the second opening 22 is defined as the inlet of the pump casing 10, and the second side 18 of the casing body 12 may be referred to as the suction side of the pump casing 10. The pump casing 10 further includes a discharge 24 which provides a pathway through which fluid exits the pump casing 10.

In the prior art pump casing 10 depicted in FIGS. 1A and 1B, the casing body 12 has a center 26 which is generally established as the centerpoint defined relative to the circumferential portion 14 of the casing body 12. Consequently, the casing body 12 may be said to have a centerline 28 that lies in a plane that bisects the casing body 12 in a direction that extends along the rotational axis of the impeller and drive shaft (not shown). Accordingly, the plane in which the centerline 28 of the pump casing 10 depicted in FIG. 1A lies extends into the paper. The plane in which the centerline 28 lies is determined when the pump casing 10 is in a vertical orientation with the discharge 24 extending upwardly as depicted in FIG. 1A with the midline of the discharge in a vertical orientation.

In the prior art pump depicted in FIG. 1A, a midline 30 of the discharge 24, which generally defines the pathway and direction of fluid exiting the pump casing 10, lies in the plane of the centerline 28 of the casing body 12. This configuration of a centrifugal pump casing 10 may be used in the construction of process pumps that are used to transport clear fluids, or those fluids that have relatively little particulate matter entrained in the fluid to be processed, i.e. low duty slurry pumps. Pumps of the type depicted in FIGS. 1A and 1B may be termed "central discharge" pumps, connoting the fact that the midline 30 of the discharge 24 is oriented along the centerline 28 of the pump.

Figure 2A:
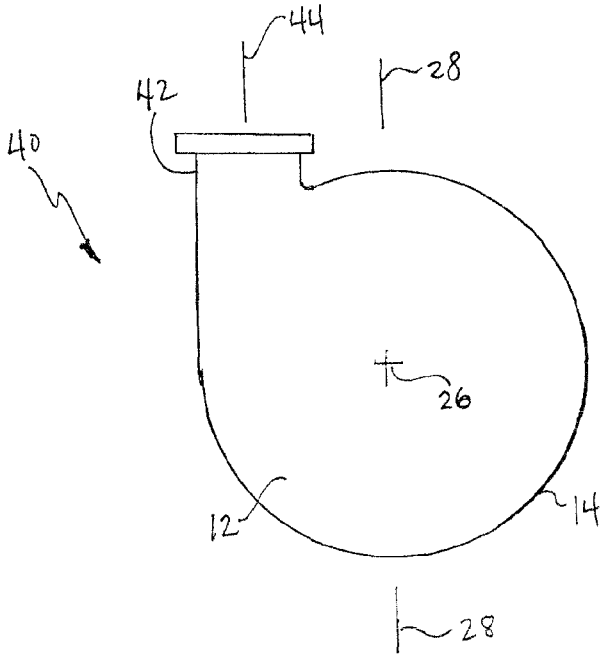
FIG. 2A (PRIOR ART)
FIG. 2A is a view in elevation of a schematic depiction of a prior art pump casing having a discharge outlet positioned tangentially to the circumference of the pump casing.
Figure 2B:
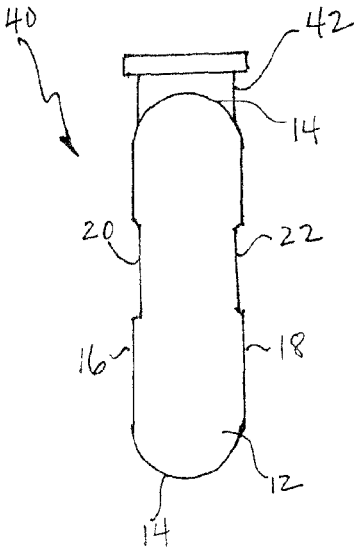
FIG. 2B (PRIOR ART)
FIG. 2B is a side view in elevation of the pump casing shown in FIG. 2A.

FIGS. 2A and 2B depict another, more common, pump casing 40 configuration. Like elements of the structures of the pump casing 10 depicted in FIGS. 1A and 1B are denominated in FIGS. 2A and 2B with like reference numerals. Thus, the pump casing 40 of FIGS. 2A and 2B comprises a casing body 12 having a first side 16, a second side 18 and a circumferential portion 14, the combination of which defines an interior space or chamber within which an impeller (not shown) is positioned in known fashion. The casing body 12 has a first opening 20 for receipt of a drive shaft therethrough for connection to the impeller. The casing body 12 also has a second opening 22 providing an inlet for fluid entering into the casing body 12, in known fashion.

The casing body 12 of the conventional pump depicted in FIGS. 2A and 2B has a discharge 42 formed in the casing body 12. However, in this configuration, the discharge 42 is tangential to the circumferential portion 14 of the casing body 12. Thus, a midline 44 of the discharge 42, which generally defines the pathway and direction of fluid flow exiting the pump casing 40, lies in a plane that is tangential relative to the circumference of the pump casing 12 and which is parallel to the plane of the centerline 28 of the casing body 12. The plane in which the midline 44 of the discharge 42 lies is spaced apart from the plane of the centerline 28. The plane of the centerline 28 is determined when the pump casing 40 is in a vertical orientation with the discharge 42 extending upwardly as depicted in FIG. 2A, and when the midline 44 of the discharge is vertically oriented. The configuration of the pump casing 40 depicted in FIGS. 2A and 2B is most prevalently used in the construction of slurry pumps that are used to process solids-entrained fluids. Pumps of the type depicted in FIGS. 2A and 2B may be termed "tangential discharge" pumps, connoting the fact that the midline 44 of the discharge lies on or in close proximity to a tangent of the outer circumference of the pump casing 12.

Figure 3:
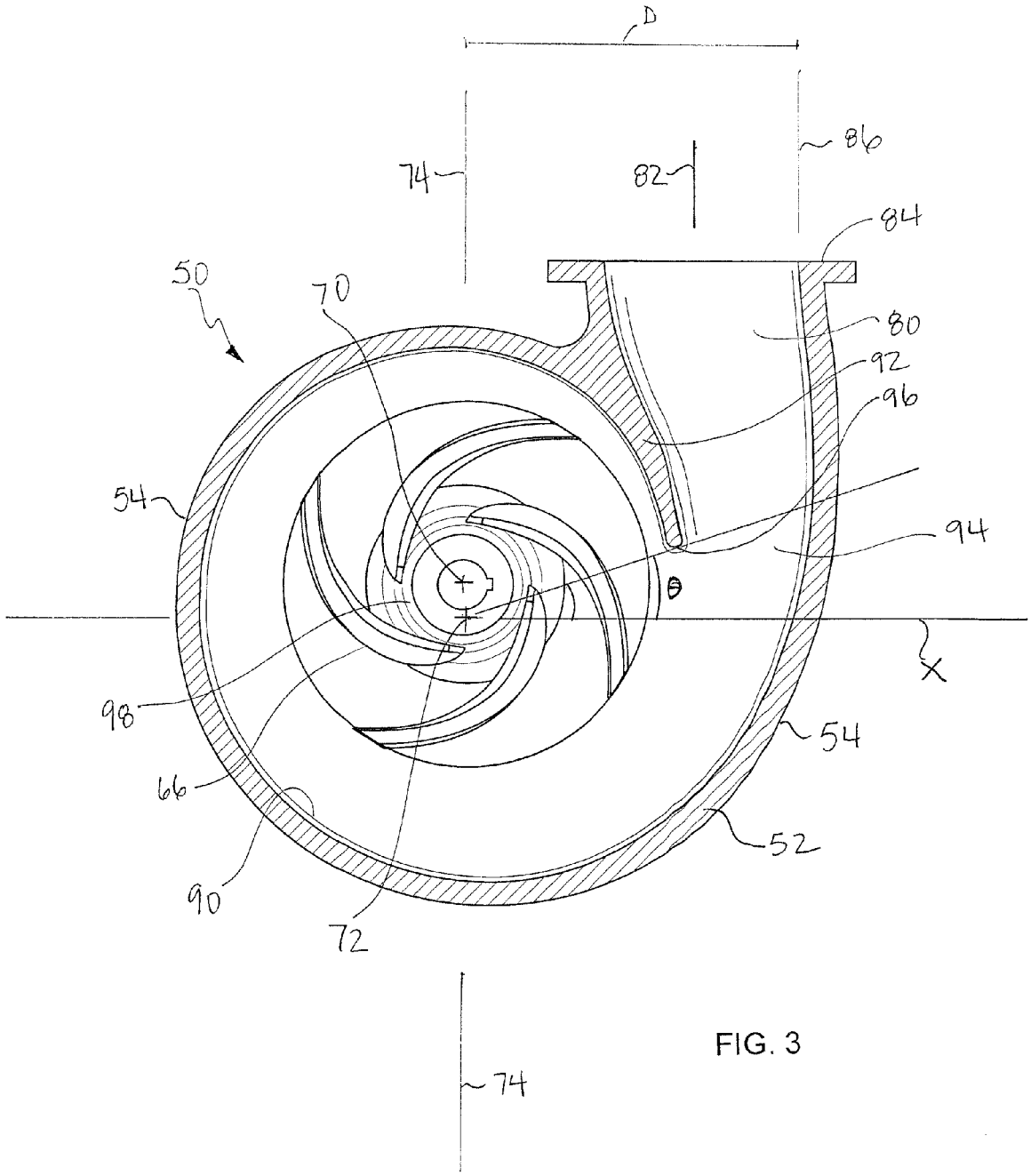
FIG. 3 is a view in elevation, and in axial cross section, of a pump casing in accordance with the present disclosure.
Figure 4:
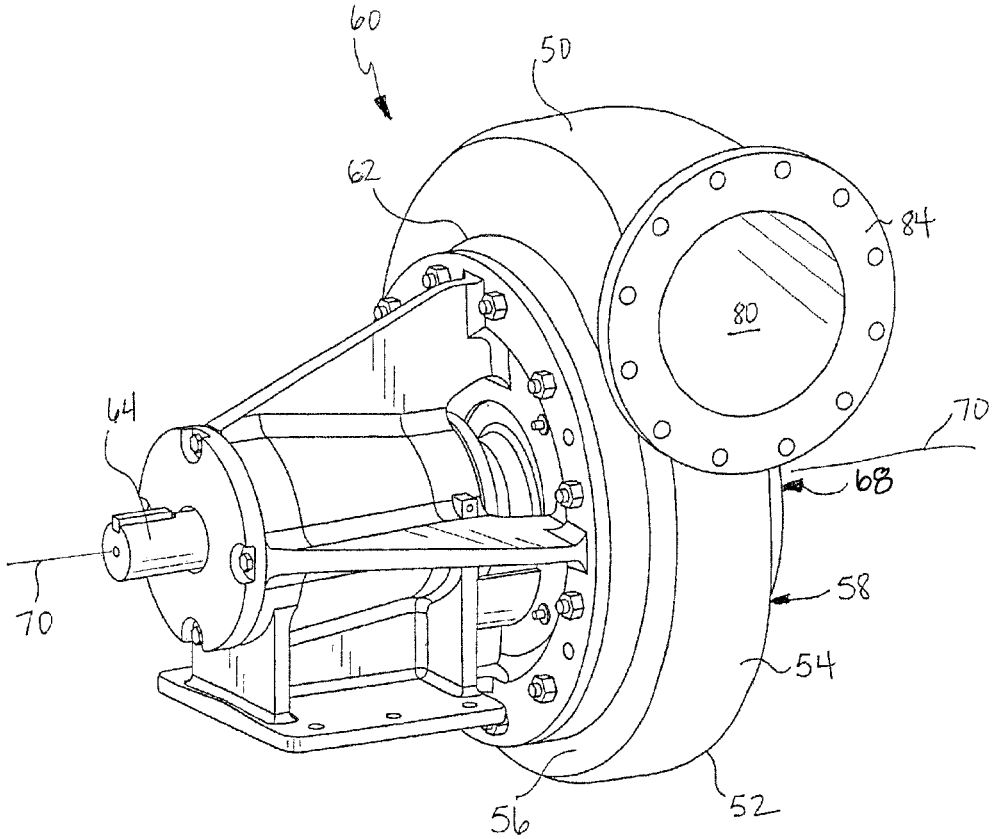
FIG. 4 is an orthogonal view of a pump configured with a pump casing in accordance with the present disclosure.

FIG. 3 depicts a pump casing 50 in accordance with the present disclosure. The pump casing 50 is comprised of a casing body 52 having a circumferential portion 54 which is defined by the circumference of the pump casing 50. The casing body 52 is formed with a first side 56 and second side 58, as shown in FIG. 4, which depicts a pump 60 in accordance with the present disclosure. An opening 62 is formed in the first side 56 of the casing body 52 through which a drive shaft 64 (FIG. 4) is positioned to engage an impeller 66 (FIG. 3) that is positioned within the pump casing 50. The drive shaft 64 defines a rotational axis 70 of the pump 60.

In the embodiment of the pump casing 50 depicted in FIG. 4, an opening 68 is provided in the second side 58 of the casing body 52 which provides an inlet for ingress of fluid into the pump. It should be noted that the opening in the pump casing 50 that defines the inlet of the pump may be formed elsewhere in the casing body 52, such as generally tangentially to the circumferential portion 54. As depicted in FIGS. 3 and 4, however, the inlet of the pump, or opening 68, is axially aligned with the drive shaft 64.

The casing body 52 of the embodiment depicted in FIG. 3 has a center 72, which is defined relative to the circumference of the casing body 52. It should be noted that the center 72 of the casing body 52 may, or may not, be coaxial with the rotational axis 70 of the impeller 66 and drive shaft 64. In the arrangement depicted in FIG. 3, the center 72 of the casing body 52 is not coaxial with the rotational axis 70 of the impeller 66 and drive shaft 64.

The pump casing 50 further includes a centerline 74 of the casing body 52 which lies in a plane that, in this particular configuration, is substantially co-extensive with a plane in which the rotational axis 70 of the impeller 62 lies. It should be noted that the plane in which the centerline 74 lies, which is determined when the pump casing 50 is in a vertical orientation with the discharge 80 extending upwardly as depicted in FIG. 3, need not be the same plane in which the rotational axis 70 lies. Both planes, however, are considered to be vertically oriented for the purposes of defining the structure of the pump 60 and pump casing 50 of this disclosure.

The casing body 52 of the present disclosure is further configured with a discharge 80 that extends generally outwardly from the circumferential portion 54 of the casing body 52. However, the discharge 80 is positioned, relative to the circumferential portion 54 of the casing body 52, such that the midline 82 of the discharge 80 is positioned away or off from the tangent line 86 of the casing body 52 by a defined distance, and is located between the tangent line 86 and the centerline 74 of the casing body 52. The midline 82 of the discharge 80 lies in a plane that is parallel to the planes in which the centerline 74 lies and the tangent line 86 lies, respectively, but is spaced between the latter two planes The midline 82 of the discharge 80 establishes a pathway of fluid flow from the discharge 80. Thus, the pump casing 50 may be said to have an offset discharge by virtue of the fact that the midline 82 is neither centered, i.e., positioned at the centerline 74 of the pump casing 50, nor tangential, i.e., positioned at or near the tangent line 86 of the pump casing 50, but is positioned between the centerline 74 and the tangent line 86. The position of the discharge 80 relative to the circumferential portion 54 or circumference of the pump casing 50 may vary such that the midline 82 of the discharge 80 is closer to the tangent line 86 of the casing body 52 or closer to the centerline 74 of the casing body 52.

The particular location of the midline 82 of the discharge 80 depicted in FIG. 3 is by way of example only. The midline 82 may be located at any number of points along the distance D between the tangent line 86 and the centerline 74. In a particularly suitable embodiment, the distance between the centerline 74 and midline 82 may be from about 20% to about 80% of the distance between the centerline 74 and the tangent line 86 of the pump casing 50. In other embodiments, the distance between the centerline 74 and midline 82 may be from about 30% to about 70% of the distance between the centerline 74 and the tangent line 86 of the pump casing 50. In still other embodiments, the distance between the centerline 74 and midline 82 may be from about 40% to about 70% of the distance between the centerline 74 and the tangent line 86 of the pump casing 50. In yet other embodiments, the distance between the centerline 74 and midline 82 may be from about 50% to about 70% of the distance between the centerline 74 and the tangent line 86 of the pump casing 50. In other embodiments, the distance between the centerline 74 and midline 82 may be from about 60% to about 70% of the distance between the centerline 74 and the tangent line 86 of the pump casing 50. In other embodiments, the distance between the centerline 74 and midline 82 may be from about 62% to about 68% of the distance between the centerline 74 and the tangent line 86 of the pump casing 50. And in other embodiments, the distance between the centerline 74 and midline 82 may be greater than 60%, but less than or equal to 80% of the distance between the centerline 74 and the tangent line 86 of the pump casing 50.

In the first instance, the configuration of the pump casing 50 of the disclosure enables the pump 60 to be incorporated into an installation where a process pump has previously been employed. That is, process pumps that are used to transport clear fluids tend to be smaller in size and cannot be readily replaced by pumps of a configuration type shown in FIGS. 1A and 2A. The pump casing 50 of the present disclosure, having a discharge 80 with a midline 82 that is offset from the tangent line 86 and offset from the centerline 74, enables a large size pump that is suitable for processing slurries to be substituted for an existing process pump without the need for reconfiguring or replacing the network of pipes that attach to the discharge. Thus, the positioning of the discharge 80 of the present embodiment enables the flange 84 of the discharge 80 to be readily attached to the existing piping network, thereby significantly reducing costs for retrofitting an existing installation.

However, while the configuration of an offset discharge 80 provides marked advantages as noted, the configuration of an offset discharge 80 gives rise to the potential for compromising the operational efficiencies of the pump. Among the challenges to pump operational efficiency is the potential for compromising the seals, which can cause fluid to leak from the pump and into the environment.

As is well known in the pump arts, a sealing mechanism of some kind is provided in the area where the drive shaft enters the pump casing. The seal mechanism or seal assembly provides a fluid barrier between the drive shaft and the casing so that fluid does not leak from the pump casing. It is also well understood that many types of pumps, and particularly centrifugal pumps, need to be primed with fluid before initiating operation of the pump. Typically, a pump is primed by flowing fluid through the pump in an amount sufficient to cover the impeller so that the impeller is pumping fluid and not air. If too much air exists in the pumping chamber, the pump may be said to "run dry." Running the pump dry may be especially deleterious to the seal mechanism, and can effectively destroy the ability of the seal mechanism or assembly to provide a fluid barrier.

Figure 5A:
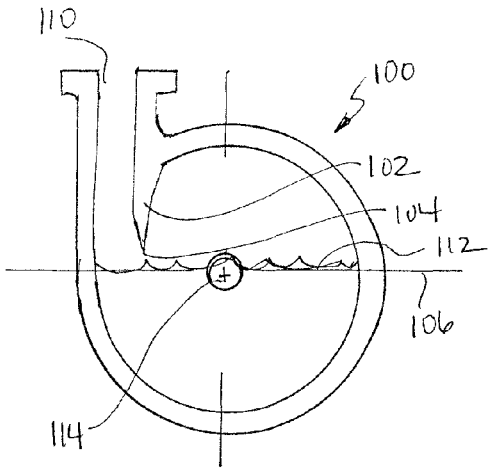
FIG. 5A (PRIOR ART)
FIG. 5A is a schematic view in cross section of a tangential discharge pump in vertical orientation depicting readiness for priming.

Many centrifugal pumps, by their construction, present the potential for running dry. For example, as illustrated in FIG. 5A, many tangential discharge pumps 100 are configured with a cutwater 102 having a leading edge 104 that extends to a point that is effectively in alignment with or positioned slightly away from a horizontal axis line 106 when the discharge 110 of the pump 100 is oriented in a vertical position. Consequently, when the pump is primed with fluid, the fluid line 112 is insufficient to cover or submerge the seal 114, and the pump will run dry, thereby damaging the seals.

Figure 6A:
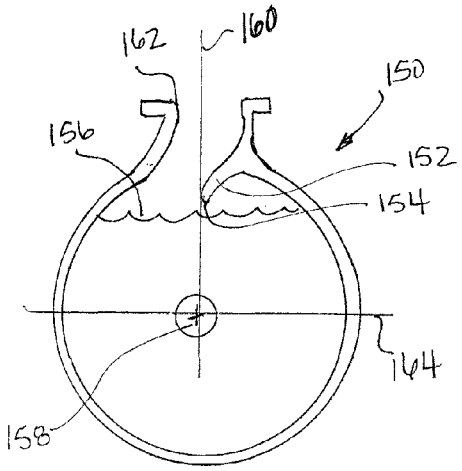
FIG. 6A (PRIOR ART)
FIG. 6A is a schematic view in cross section of a central discharge pump in vertical orientation depicting readiness for priming.

On the other hand, as illustrated in FIG. 6A, many central discharge pumps 150 are configured with a cutwater 152 having a leading edge 154 that is of lesser extended length. When the pump 150 is in a vertical orientation, as shown, and is primed with fluid, the fluid line 156 is sufficient to submerge the seal 158, and the pump 150 will not run dry.

Figure 5B:
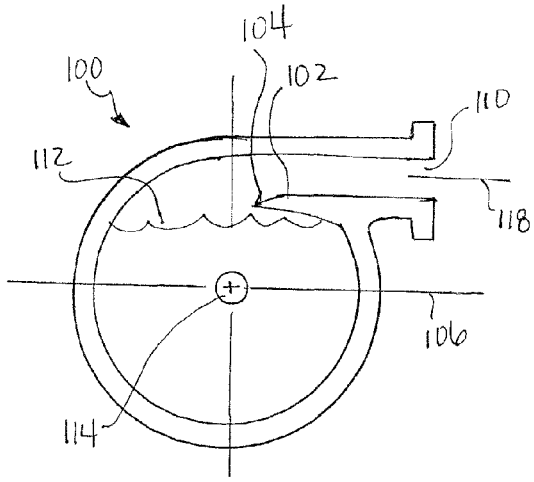
FIG. 5B (PRIOR ART)
FIG. 5B is a schematic view in cross section of a tangential discharge pump in horizontal orientation depicting readiness for priming.
Figure 6B:
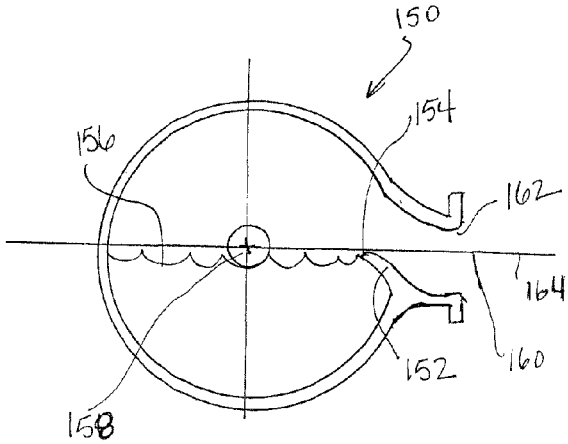
FIG. 6B (PRIOR ART)
FIG. 6B is a schematic view in cross section of a central discharge pump in horizontal orientation depicting readiness for priming.

However, as illustrated further in FIG. 5B, when a tangential discharge pump 100 is oriented horizontally, where the midline 118 of the tangential discharge 110 is oriented horizontally, the leading edge 104 of the cutwater 102 is configured such that the pump is able to retain a sufficient amount of fluid when primed to prevent the pump from running dry. Conversely, as shown in FIG. 6B, when a central discharge pump 150 is oriented horizontally for operation, where the midline 160 of the discharge 162 is oriented horizontally, the leading edge 154 of the cutwater 152 is positioned at or near a horizontal axis 164 of the pump 150 and the pump 150 is incapable of retaining sufficient fluid to submerge the seal 158, and the pump will run dry.

Thus, conventional tangential discharge pumps and central discharge pumps, by their configurations, present limitations to their use in all applications and in all orientations, as demonstrated in FIGS. 5A and 5B and FIGS. 6A and 6B.

The pump casings and pumps of the present disclosure are especially configured to provide a pump which is not only capable of being employed in any number of applications and in any number of orientations, but the pump casing is particularly configured to assure proper priming of the pump to thereby improve pump efficiencies.

Accordingly, as shown in the cross section view of the pump casing 50 depicted in FIG. 3, the pump casing 50 includes a volute 90 which is defined by the circumferential portion 54 of the casing body 52. The pump casing 50 is configured with a cutwater 92 that is positioned in proximity to the throat 94 of the discharge 80. The cutwater 92 extends downwardly from the circumferential portion 54, and volute 90, to terminate in a leading edge 96. When the pump casing 50 is in a vertical orientation, as shown in FIG. 3, and a horizontal axis line X and vertical axis line Y are drawn through the center 72 of the pump casing 50, the leading edge 96 is positioned at an angle Θ relative to the horizontal axis line X. The angle Θ can be anywhere from about five degrees to about 50 degrees. In one particularly embodiment, the angle Θ is from about five degrees to about forty degrees. In another suitable embodiment, the angle Θ is from about five degrees to about thirty degrees. In yet another embodiment, the angle Θ is from about five degrees to about twenty degrees. In still other embodiments, the angle Θ is from about five degrees to about fifteen degrees. In other embodiments, the angle Θ is from about seven degrees to about thirteen degrees. In still other embodiments, the angle Θ is from about nine degrees to about eleven degrees. In yet other embodiments, the angle Θ is greater than zero degrees, and is less than fifty degrees.

Figure 7A:
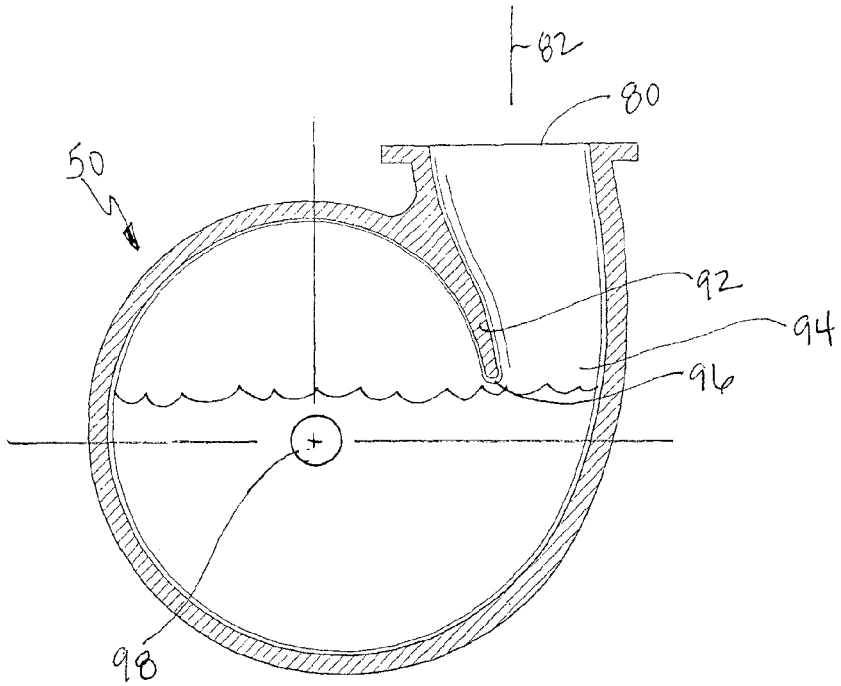
FIG. 7A is a view in cross section of a pump casing of the present disclosure in vertical orientation depicting readiness for priming.
Figure 7B:
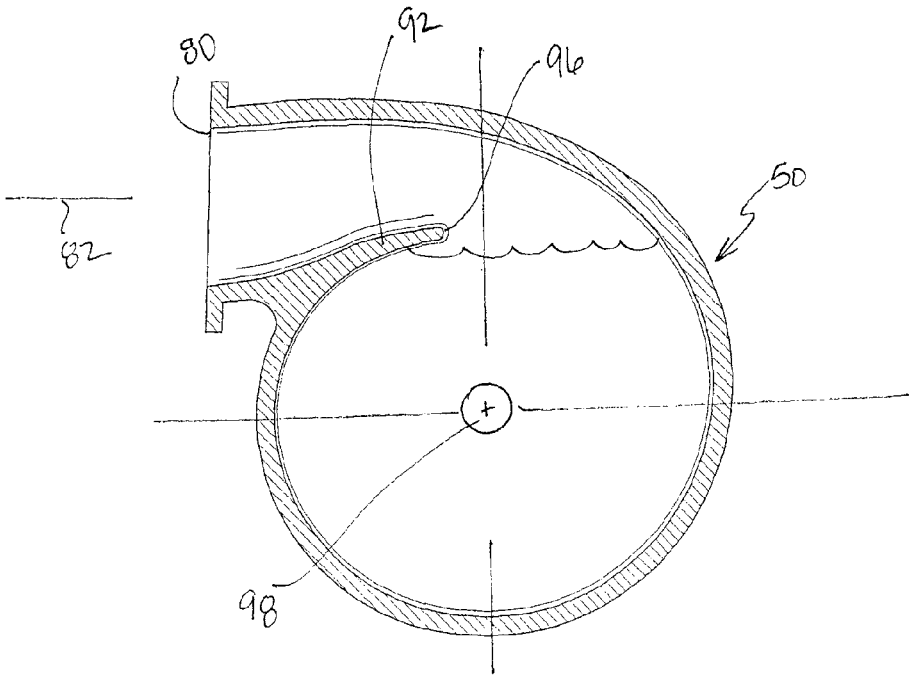
FIG. 7B is a view in cross section of a pump casing of the present disclosure in horizontal orientation depicting readiness for priming.

The positioning of the cutwater 92 at an angle to the center of the pump casing 50 and in close proximity to the throat 94 of discharge 80 provides an advantage in the ability to maintain pump performance and pump efficiencies in the processing of certain fluids. Specifically, the positioning of the leading edge 96 of the cutwater 92 assures that the pump casing 50 will retain sufficient fluid during priming to assure that the seal 98 remains submerged during priming, both when the pump casing is in a vertical orientation and in a horizontal orientation, as illustrated in FIGS. 7A and 7B.

The pump casing 50 of the present disclosure is suitable for processing slurries and may be used to pump both slurries containing more aggressive solids and fluids containing lesser amounts of entrained solids. The pump casing 50 may also be employed in any number of orientations, from vertical to horizontal.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "left" and right", "front" and "rear", "above" and "below" and the like are used as words of convenience to provide reference points and are not to be construed as limiting terms.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

In addition, the foregoing describes only some embodiments of the invention(s), and alterations, modifications, additions and/or changes can be made thereto without departing from the scope and spirit of the disclosed embodiments, the embodiments being illustrative and not restrictive.

Furthermore, invention(s) have described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention(s). Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

What is claimed is:

1. A pump casing for a centrifugal pump, comprising:

a casing body having a circumferential portion and a centerline;

an opening formed in the casing body to provide receipt of a drive shaft therethrough;

an opening formed in the casing body to provide an inlet pathway for fluid to enter the casing body; and a discharge formed in the casing body, the discharge having a midline, wherein the centerline of the casing body is determined when the casing body is in a vertical orientation with the discharge and the midline of the discharge oriented vertically and the centerline lies in a vertical plane, and wherein the midline of the discharge is located at a midpoint of the distance between the centerline of the casing body and a tangential line of the casing body that extends parallel to the centerline of the casing body.

2. The pump casing according to claim 1, wherein the midline of the discharge is parallel to the centerline and tangential line of the casing body.

3. The pump casing according to claim 1, further comprising a flange associated with the discharge.

* * * * *